United States Patent [19]

Hillberg

[11] 4,291,481

[45] Sep. 29, 1981

[54] FIREARM MAGAZINE SAFETY MECHANISM

[75] Inventor: Robert L. Hillberg, Cheshire, Conn.

[73] Assignee: Wildey Firearms Company, Inc., Cold Spring, N.Y.

[21] Appl. No.: 19,906

[22] Filed: Mar. 12, 1979

[51] Int. Cl.[3] ..... F41C 17/08

[52] U.S. Cl. ..... 42/70 A

[58] Field of Search ..... 42/70 A, 7; 89/196, 89/195

[56] References Cited

U.S. PATENT DOCUMENTS

| | | | |
|---|---|---|---|
| 3,715,826 | 2/1973 | Seifried | 42/70 A |
| 4,016,669 | 4/1977 | Gminder | 42/70 A |
| 4,031,648 | 6/1977 | Thomas | 42/70 A |

FOREIGN PATENT DOCUMENTS

| | | | |
|---|---|---|---|
| 672094 | 2/1939 | Fed. Rep. of Germany | 42/7 |

*Primary Examiner*—Charles T. Jordan

*Attorney, Agent, or Firm*—McCormick, Paulding & Huber

[57] ABSTRACT

A magazine loaded pistol has a safety mechanism for disabling its trigger when its magazine is removed. A disabling member supported for reciprocal sliding movement on the pistol frame extends through and moves within a passageway in the trigger and is retained by the trigger pivot pin. When the magazine is removed the disabling member is biased to a safety position wherein an abutment surface thereon is aligned with a stop surface on the trigger to block trigger movement.

16 Claims, 9 Drawing Figures

FIREARM MAGAZINE SAFETY MECHANISM

BACKGROUND OF THE INVENTION

This invention relates in general to safety devices for firearms and deals more particularly with an improved safety mechanism for a magazine loaded firearm which disables the firearm when its magazine is removed. An automatic or semi-automatic firearm of the aforedescribed type is potentially dangerous after its magazine has been removed, since a cartridge may remain in its firing chamber. Heretofore various magazine operated safety devices have been provided for disabling the firing mechanism of such a firearm. A typical safety mechanism of the aforedescribed general type is illustrated and described in U.S. Pat. No. 4,016,669, for example, and includes a magazine operated slide which either blocks or unblocks the trigger of a firearm depending on whether the magazine is in or out of its magazine well. The present invention is concerned with an improved magazine safety mechanism of the aforedescribed general type. It is the general aim of the present inventon to provide an improved, compact magazine safety mechanism which has relatively few parts, is easy to assemble and disassemble and has positive automatic mechanical action.

SUMMARY OF THE INVENTION

In accordance with the present invention a safety mechanism for a magazine loaded firearm comprises a disabling member supported for movement within an opening in the trigger of the firearm and arranged to move between an off position corresponding to an active condition of the trigger mechanism and a safety position corresponding to a disabled condition of the trigger mechanism. The disabling member is maintained in its off or released position by a magazine positioned within a magazine well in the firearm and moves automatically to safety position when the magazine is withdrawn from the magazine well.

DETAILED DESCRIPTION OF PREFERRED EMBODIMENT

Figure 1:
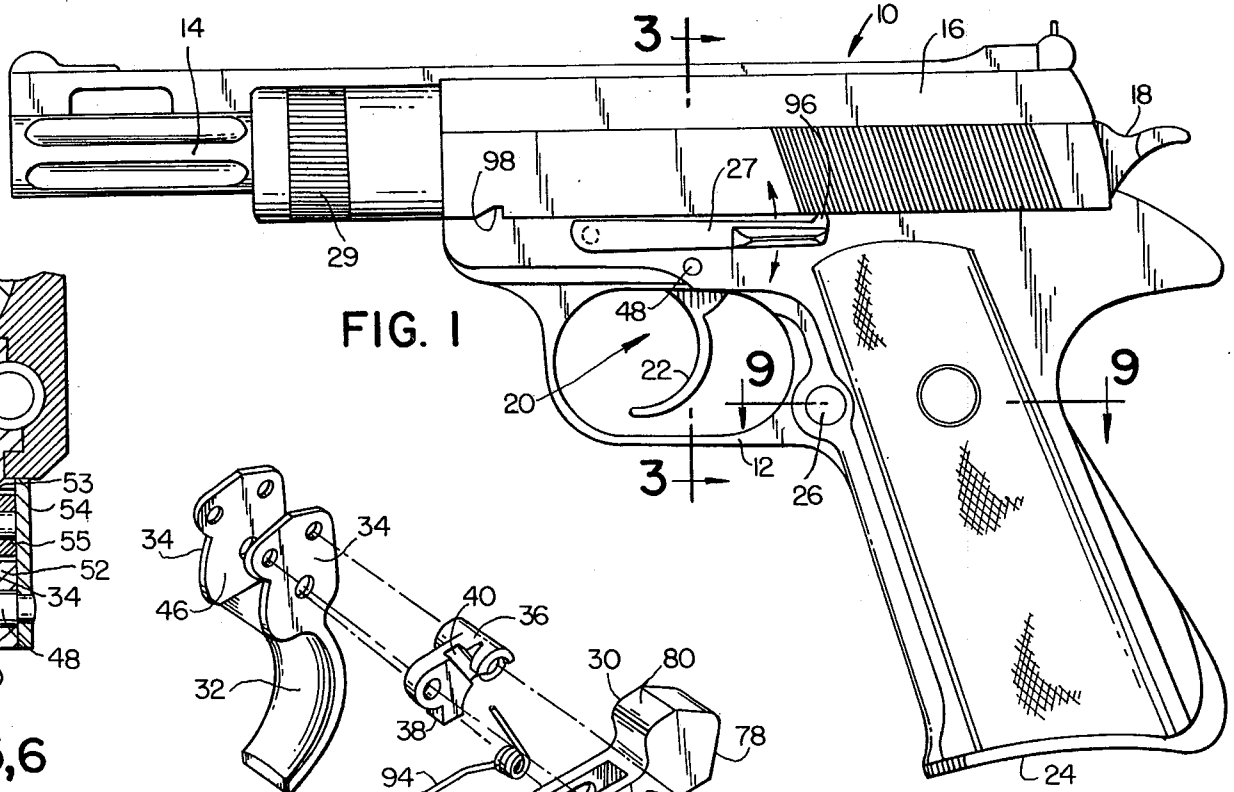
FIG. 1 is an elevational view of a magazine loaded firearm which has a safety mechanism embodying the present invention.

In the drawings and in the further description which follows, a safety mechanism embodying the present invention is illustrated and described with reference to a magazine loaded, gas operated pistol indicated generally by the reference numeral 10 in FIG. 1. The pistol 10 is of the type shown in U.S. Pat. No. 3,988,964 to Moor, issued Nov. 2, 1976. The present safety mechanism is particularly well adapted to such a firearm, since it requires relatively few parts which are arranged in relatively compact form. However, it should be understood that the invention is not limited to the particular firearm shown and described, but may be used with other firearms of magazine loaded type.

The illustrated pistol 10 generally comprises a frame 12, a barrel 14, a slide 16, a firing mechanism which includes a hammer 18, a trigger mechanism indicated generally at 20 which includes a trigger 22, and a slide stop 27. A box magazine, indicated at 24 and contained within a magazine well 25 formed in the handle part of the frame, is retained in the magazine well by a magazine release catch 26.

The slide 16 is shown in a forward position from which it is movable rearwardly, either manually or in response to the gasses of explosion generated during the firing of a cartridge, to operate a bolt assembly (not shown) which includes a firing pin and an extractor. An adjuster, indicated at 29 is movable angularly relative to the barrel 14 to vary the gas pressure which moves the slide 16. As the slide moves rearwardly during the firing of a cartridge the bolt unlocks and moves rearwardly cocking the hammer 18 and extracting the spent cartridge shell. When the slide is in its forward position and the hammer 18 is in a down position, shown in FIG. 1, the hammer may be moved to a cocked position by thumb-pressure applied to its spur for subsequent firing in a single action manner. The pistol 10 can also be fired, in a double action manner, by simply squeezing the trigger 22 when the hammer 18 is in its down position.

In accordance with the present invention, the pistol 10 has a magazine safety mechanism for disabling the trigger mechanism 20 when a magazine, such as the magazine 24 is removed from the magazine well 25. The magazine safety mechanism, indicated generally at 28, and best shown in FIGS. 2–5, comprises a disabling member or slide 30 which cooperates with the trigger 22 to disable the trigger mechanism 20, as will be hereinafter further discussed.

Figure 2:
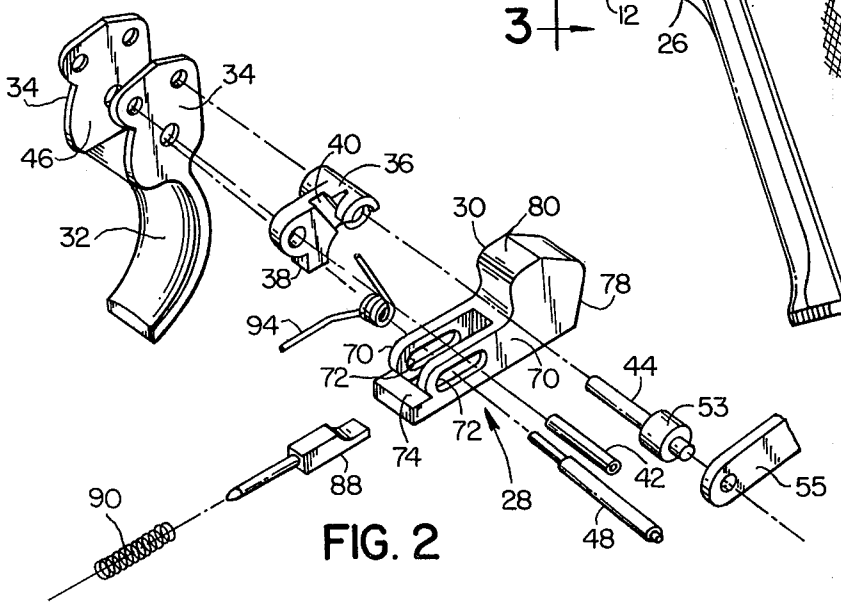
FIG. 2 is a somewhat enlarged exploded view of the magazine safety mechanism and parts of the trigger mechanism of the firearm of FIG. 1.
Figure 3:
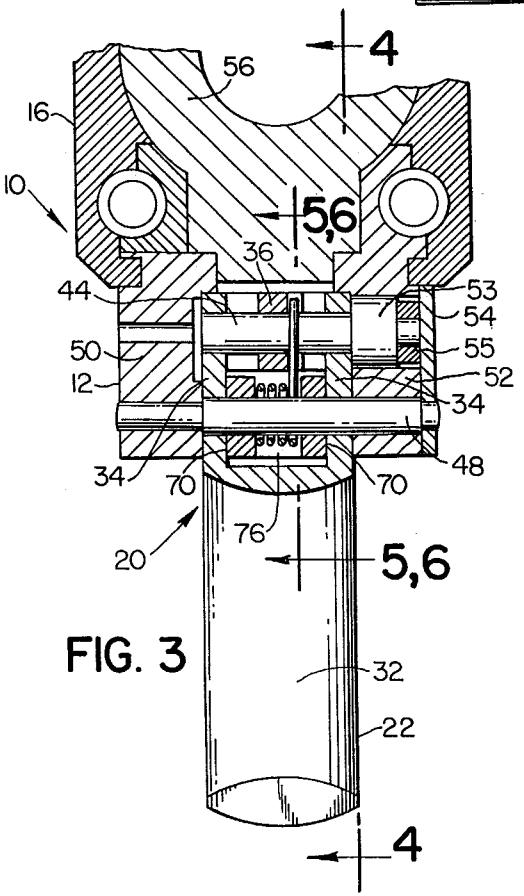
FIG. 3 is a somewhat further enlarged fragmentary transverse sectional view taken generally along the lines 3—3 of FIG. 1.
Figure 6:
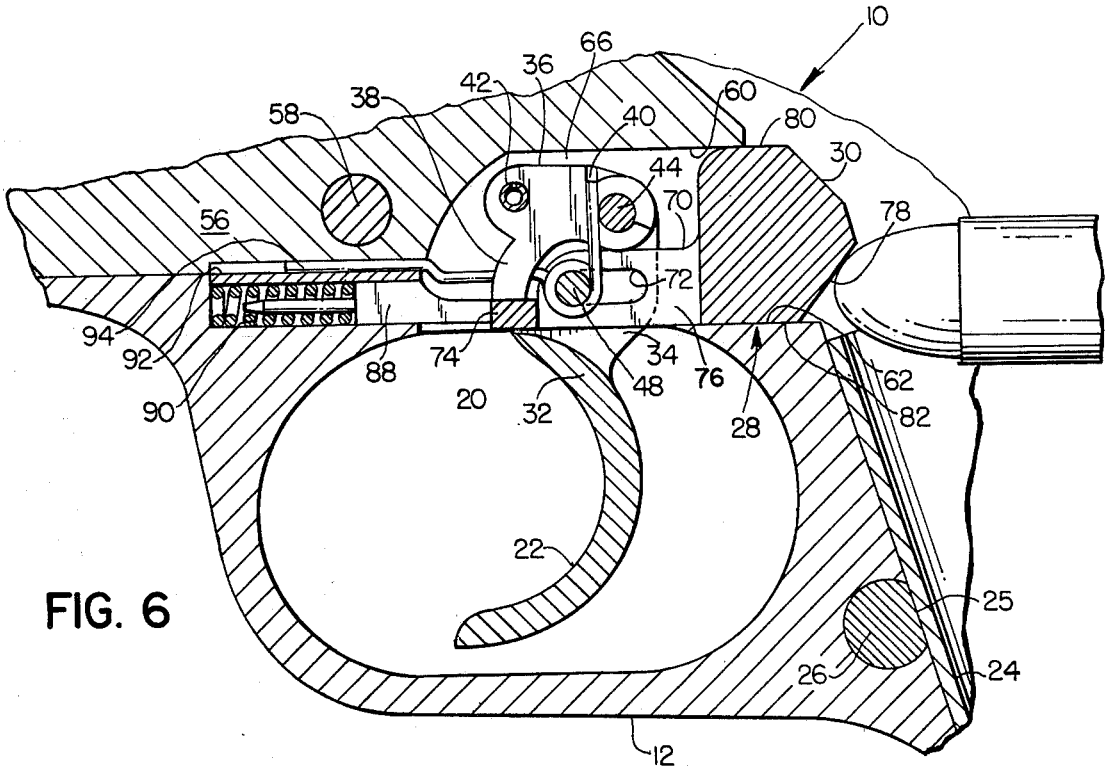
FIG. 6 is similar to FIG. 5, but shows the magazine in a partially withdrawn position and the safety mechanism in its safety position.

Considering now the pistol 10 in further detail and particularly the construction and arrangement of the magazine safety mechanism 28, the trigger 22 is preferably made in two parts, as best shown in FIG. 2. One trigger part, indicated at 32, includes a finger piece and has a pair of transversely spaced, upwardly extending ears 34, 34. The other trigger part, indicated at 36, has a stop 38 and a spring retaining recess 40 and is secured between the ears 34, 34 by a roll pin 42 and a trigger bar retaining pin 44. The parts 32 and 36 cooperate to define an opening or passageway 46 which extends through the trigger 22, as best shown in FIG. 6. The trigger 22 is mounted on a transverse pivot pin 48 which extends between two side walls 50 and 52 of the frame 12, as best shown in FIG. 3. The pin 44 has an enlarged cylindrical spacer 53 spaced inwardly from one of its ends. A removable cover plate 54 mounted adjacent the side wall 52 retains the pin 48 in place. A trigger bar 55 which comprises part of the trigger mechanism 20 is retained on the pin 44 between the spacer 53 and the cover plate 54.

Figure 4:
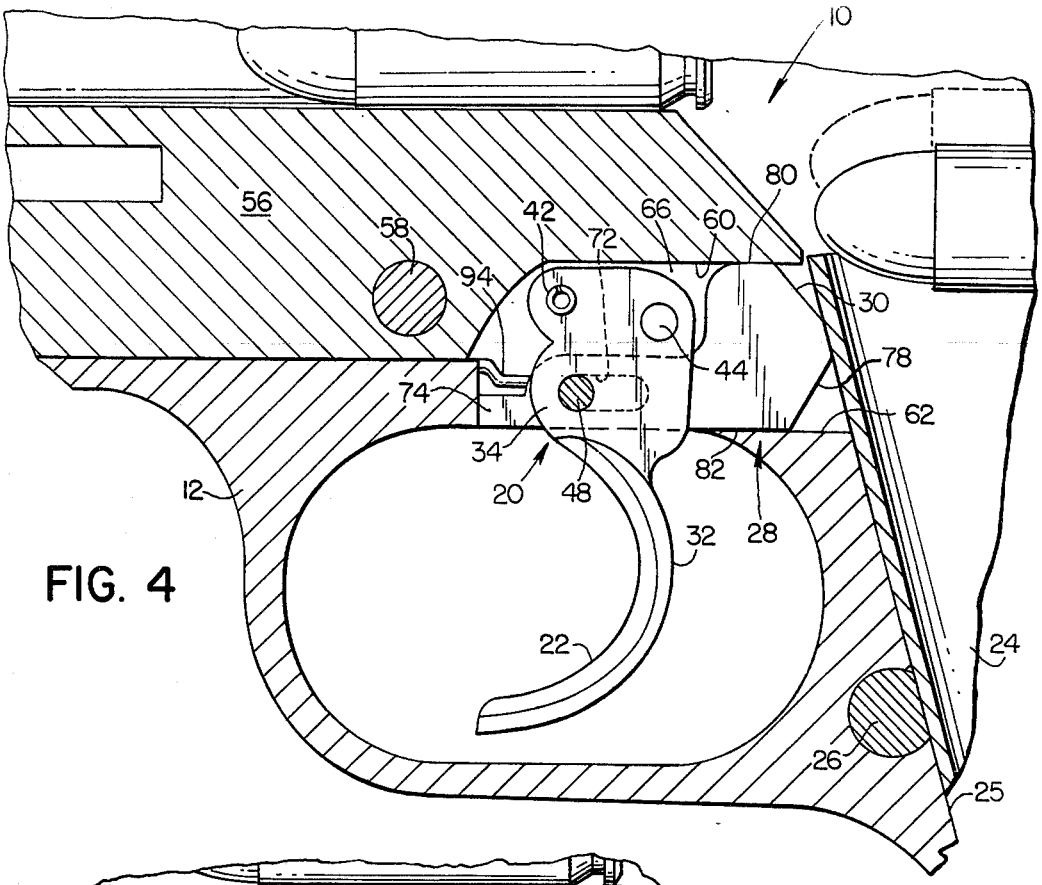
FIG. 4 is a fragmentary sectional view taken generally along the line 4—4 of FIG. 3 and shows the firearm with a magazine positioned in its magazine well and the magazine safety mechanism in its released position.
Figure 5:
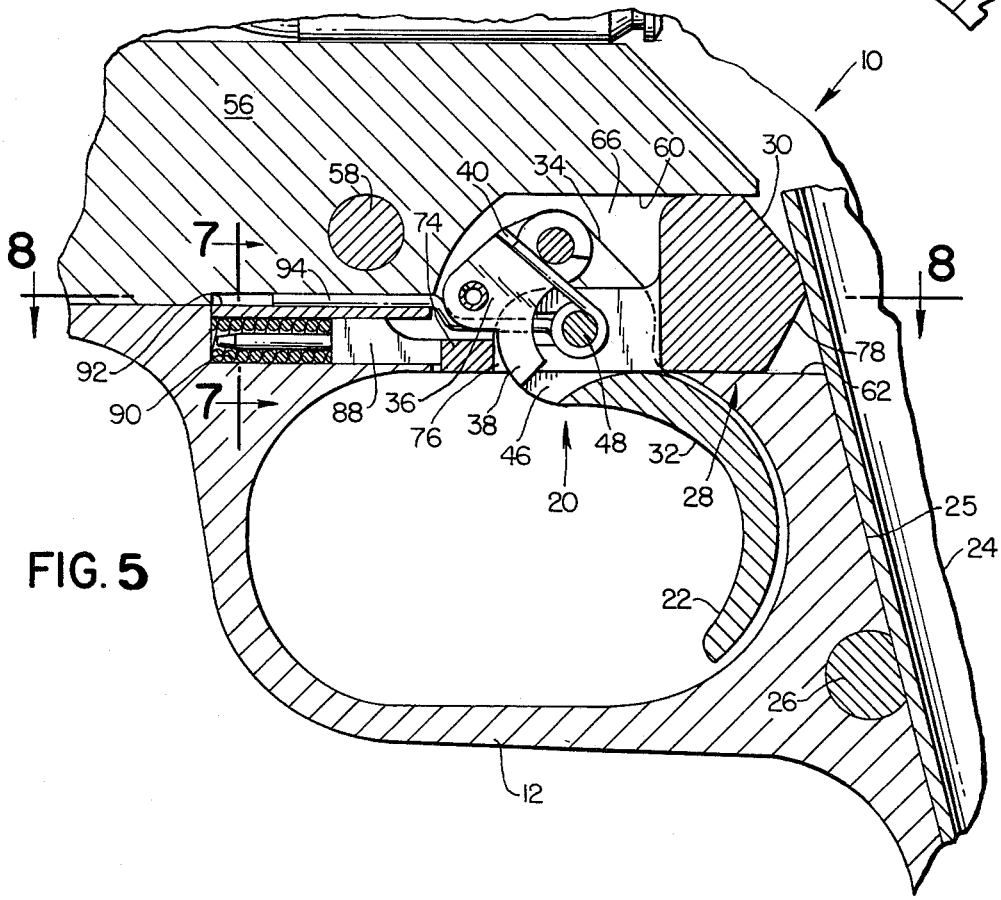
FIG. 5 is a fragmentary sectional view taken generally along the lines 5—5 of FIG. 3 and shows the firearm with a magazine positioned in the magazine well, the magazine safety mechanism in its released position, and the trigger in a drawn back position.

A receiver 56, which defines the firing chamber and into which the breech end of the barrel 14 is threaded, is mounted between the side walls 50 and 52 and releasably retained in assembly with the frame by a transverse pin 58 which also provides pivotal support for the slide stop 27. The lower rear portion of the receiver 56 is relieved or cut away below the firing chamber and defines a downwardly facing guide surface 60. The side walls 50 and 52, the guide surface 60, and another opposing guide surface 62 on the frame 12 cooperate to define a recess 66 which communicates with the magazine well 25, as shown in FIGS. 4–6.

Preferably, and as shown, the slide 30 is retained in assembly with the pistol 10 by the trigger pivot pin 48. More specifically, the forward portion of the slide is received between the ears 34, 34 and extends into and through the passageway 46 formed in the trigger. Transversely spaced ears 70, 70 on the forward part of the slide define slots 72, 72 which receive the trigger pin 48 therethrough. The forward end portion of the slide extends beyond the ears 70, 70 and has an abutment 74 thereon. An aperture 76 extends through the slide 30 between the ears 70, 70, for a purpose which will be hereinafter evident. At its rear end the slide 30 has a rearwardly facing and upwardly and rearwardly inclined cam surface 78. The slide is supported for reciprocal sliding movement relative to the frame 12 and the trigger 22 by upper and lower slide surfaces respectively indicated at 80 and 82 which respectively engage the guide surfaces 60 and 62 on the receiver and the frame 12.

Figure 7:
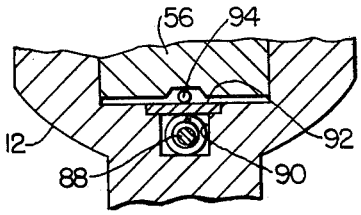
FIG. 7 is a fragmentary sectional view taken generally along lines 7—7 of FIG. 5.
Figure 8:
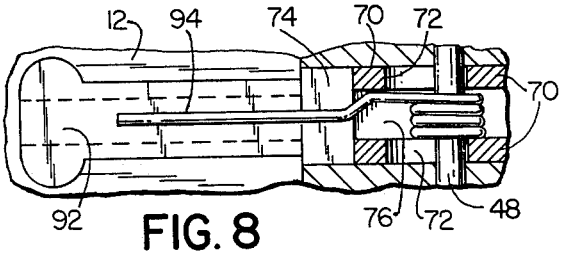
FIG. 8 is a fragmentary sectional view taken generally along the lines 8—8 of FIG. 5.

A spring biased plunger 88 received within a recess 90, formed in the frame above the forward end of the trigger guard, bears against the forward end of the slide 30 and biases it rearwardly toward the magazine well 25 and toward a safety position, in which it appears in FIG. 6. A cover plate 92 overlies the recess 90 and retains the plunger 88 therein. The finger piece of the trigger 22 is normally biased to a forward position by a coil spring 94 received on the trigger pivot pin 48 between the slide ears 70, 70. One leg of the coil spring is received within the spring receiving recess 40 in the trigger. The other leg of the spring has an offset portion which bears downwardly against the plate 92 and is disposed within a shallow recess formed in the receiver 56 as best shown in FIG. 7.

Figure 9:
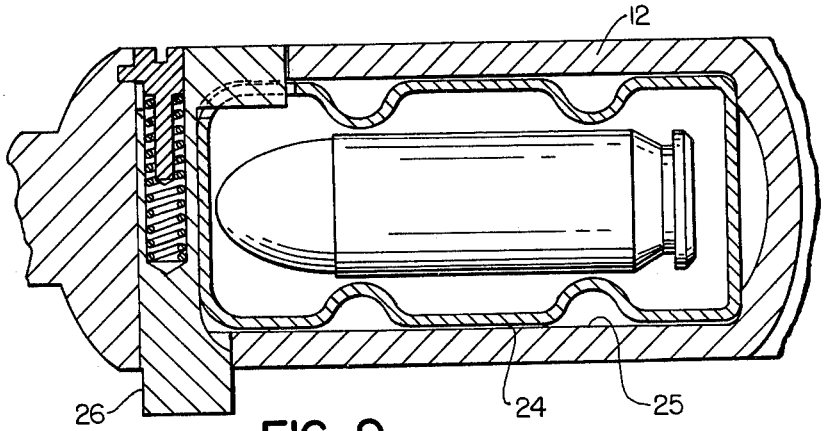
FIG. 9 is a somewhat enlarged fragmentary sectional view taken along the line 9—9 of FIG. 1.

When the magazine 24 is removed from the pistol 10 the slide 30 is urged by the spring biased plunger 90 toward and to its safety position of FIG. 6. The trigger pivot pin 48 which retains the slide cooperates with the slots 72, 72 to limit its rearward travel. When the slide 30 is in its safety position, the abutment 74 is aligned with the stop 38 on the trigger and prevents pivotal movement of the trigger 22 in counterclockwise direction from its position of FIG. 6 and corresponding rearward movement of the trigger finger piece. Thus, the trigger mechanism 20 is disabled when the magazine 24 is removed from the magazine well 25. When a full magazine such as the magazine 24 is inserted into the magazine well 25 in the handle the nose of a cartridge, which projects from the magazine, first engages the cam surface 78 which urges the slide 30 in a forward direction and toward an off position in opposition to the biasing force exerted by the spring biased plunger 88. The magazine is inserted into the handle and pushed in until it locks. This locking action is produced by the magazine catch 26 which snaps into a notch cut into the upper forward end portion of the magazine as shown in FIG. 9. Engagement of the cam surface 78 by the forward surface of the magazine 24 further biases the slide 30 to its fully forward or off position shown in FIGS. 5 and 6 wherein the abutment 74 is out of alignment with the stop 38 on the trigger. The stop 38 is now aligned with the aperture 76 so that the trigger 22 is free to pivot in a counterclockwise direction in response to rearward squeezing pressure on the finger piece whereby the trigger bar is pulled in a forward direction to release a sear (not shown) to operate the firing mechanism which releases the hammer 18 from a cocked position.

When the last cartridge is fired the slide stop 27 operates to releasably retain the slide 16 in a rearward or open position. The slide stop, shown in FIG. 1, is mounted at its forward end on the pin 58 to pivot relative to the frame 12 and is normally biased in a clockwise direction by means not shown to the position in which it appears in FIG. 1. When the last cartridge is stripped from the magazine 24 the magazine follower (not shown) presses upwardly against an inwardly extending projection at the rear end of the slide stop 27 which extends through an opening in the side wall and into the path of the magazine follower. The slide stop is biased in a counterclockwise direction from its position in FIG. 1 by the magazine follower causing a projection 96 at the rear end of the slide stop to press upwardly against an associated lower edge of the slide 16. When the last shot is fired the projection 96 engages within a niche 98 in the slide thereby releasably retaining the slide in its rearward position.

To reload from the open slide position the magazine release catch 26 is pressed and the empty magazine is removed. A loaded magazine is then inserted into the magazine well 25. The slide is released by pressing down on the slide stop 27 with the right thumb. Springs which act between the slide 16 and the frame 12 move the slide to its forward position thereby feeding a cartridge from the magazine into the firing chamber.

I claim:

1. In a firearm having a frame including a magazine well, a magazine releasably retained in the well, a firing mechanism movable between cocked and released positions, a trigger mechanism for releasing the firing mechanism from a cocked position and including a trigger, means supporting the trigger for movement between forward and rearward positions respectively corresponding to cocked and released positions of the firing mechanism, and means for disabling the trigger mechanism to prevent it from releasing the firing mechanism from a cocked position when the magazine is removed from the well, the improvement comprising said trigger having an opening therethrough, said disabling means including a disabling member supported for movement within said opening and relative to said trigger and said frame between safety and off positions, said means for supporting said trigger comprising means for retaining said disabling member, said disabling member in its safety position preventing operation of said trigger mechanism to release said firing mechanism, said disabling member in its off position permitting operation of said trigger mechanism to release said firing mechanism, said disabling member being movable to its off position in response to insertion of a magazine into said magazine well.

2. In a firearm as set forth in claim 1 the further improvement comprising said means for supporting said trigger including a pin supporting said trigger for pivotal movement relative to said frame.

3. In a firearm as set forth in claim 2 the further improvement comprising said disabling member being supported for reciprocal sliding movement relative to said frame and having a slot therein receiving said pin therethrough.

4. In a firearm as set forth in either claim 1 or claim 2 the further improvement comprising said trigger having a stop and said disabling member having an abutment aligned with said stop and blocking movement of said trigger when said disabling member is in its safety position.

5. In a firearm as set forth in claim 4 the further improvement comprising said disabling member having an aperture aligned with said stop and through which said stop may pass when said disabling member is in its off position.

6. In a firearm as set forth in claim 5 the further improvement comprising said trigger having a plurality of parts and said stop is carried by one of said parts and said opening is formed in another of said parts.

7. In a firearm as set forth in claim 1 the further improvement wherein said opening comprises a passageway and said trigger includes a plurality of parts cooperating to define said passageway.

8. In a firearm as set forth in claim 7 the further improvement wherein one of said parts has a pair of spaced apart ears and another of said parts is received between said ears and cooperates with said one part to define said passageway.

9. In a firearm as set forth in either claim 1 or claim 2 the further improvement comprising means for biasing said disabling member in the direction of said magazine well and toward said safety position wherein an end portion of said disabling member is disposed within said magazine well, said disabling member being movable to its off position in response to insertion of a magazine into said well and being retained in said off position by said magazine positioned in said well.

10. In a firearm as set forth in claim 9 the further improvement wherein said trigger is supported for pivotal movement relative to said frame by said supporting means and said disabling member is supported for reciprocal sliding movement relative to said frame.

11. In a firearm as set forth in claim 10 wherein said pistol includes a receiver releasably retained in assembly with said frame, said receiver and said frame define opposing guide surfaces, and said disabling member has slide surfaces thereon respectively engaging said guide surfaces and supporting said disabling member for reciprocal sliding movement relative to said frame.

12. A firearm comprising a frame including a magazine well, a magazine releasably retained in the well, a firing mechanism movable between cocked and released conditions, a trigger mechanism for releasing the firing mechanism from a cocked condition and including a trigger member, means supporting the trigger member for movement between forward and rearward positions respectively corresponding to cocked and released conditions of the firing mechanism, means for disabling the trigger mechanism to prevent it from releasing the firing mechanism from a cocked condition when the magazine is removed from the well and including a disabling member supported for movement between safety and off positions, said disabling member in its safety position preventing operation of said trigger mechanism to release said firing mechanism, said disabling member in its off position permitting operation of said trigger mechanism to release said firing mechanism, said disabling member being movable to its off position in response to insertion of a magazine into said magazine well, and a single means for supporting the members comprising said trigger member and said disabling member for movement between said positions.

13. A firearm as set forth in claim 12 wherein said single means comprises a pivot pin supporting said trigger member for pivotal movement relative to the frame and retaining said disabling member for reciprocal sliding movement relative to the frame.

14. A firearm as set forth in either claim 12 or claim 13 wherein one of said members has an opening therethrough and the other of said members is supported for movement within said opening.

15. In a firearm having a frame including a magazine well, a magazine releasably retained in the well, a firing mechanism movable between cocked and released positions, a trigger mechanism for releasing the firing mechanism from a cocked position and including a trigger, a pivot pin supporting the trigger for pivotal movement between forward and rearward positions respectively corresponding to cocked and released positions of the firing mechanism, and means for disabling the trigger mechanism to prevent it from releasing the firing mechanism from a cocked position when the magazine is removed from the well, the improvement comprising said trigger having a plurality of parts, one of said parts having a pair of spaced apart portions and another of said parts received between said spaced apart portions and cooperating with said one part to define a passageway through said trigger, said disabling means including a disabling member having a slot therein receiving said pivot pin therethrough and supported for reciprocal sliding movement within said passageway and relative to said trigger and said frame between safety and off positions, said disabling member in its safety position preventing operation of said trigger mechanism to release said firing mechanism, said disabling member in its off position permitting operation of said trigger mechanism to release said firing mechanism, said disabling member being movable to its off position in response to insertion of a magazine into said magazine well.

16. In a firearm as set forth in claim 15 the further improvement wherein one of said parts has a stop and said disabling member has an abutment disposed in the path of said stop when said disabling member is in its safety position and an aperture aligned with said stop and through which said stop may pass when said disabling member is in its off position.

* * * * *